US009508484B2

(12) United States Patent
Scholz

(10) Patent No.: US 9,508,484 B2
(45) Date of Patent: Nov. 29, 2016

(54) PLANAR TRANSMITTER WITH A LAYERED STRUCTURE

(71) Applicant: Phoenix Contact GmbH & Co. KG, Blomberg (DE)

(72) Inventor: Peter-Dominik Scholz, Brakel (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 14/376,189

(22) PCT Filed: Feb. 18, 2013

(86) PCT No.: PCT/EP2013/000468

§ 371 (c)(1),
(2) Date: Aug. 1, 2014

(87) PCT Pub. No.: WO2013/124048

PCT Pub. Date: Aug. 29, 2013

(65) Prior Publication Data

US 2014/0375411 A1 Dec. 25, 2014

(30) Foreign Application Priority Data

Feb. 22, 2012 (DE) ..... 10 2012 003 365
Aug. 22, 2012 (DE) ..... 10 2012 016 568

(51) Int. Cl.
*H01F 27/28* (2006.01)
*H01F 17/04* (2006.01)
(Continued)

(52) U.S. Cl.
CPC ..... *H01F 27/2804* (2013.01); *H01F 27/32* (2013.01); *H01F 27/323* (2013.01); *H01F 2027/2809* (2013.01); *H01F 2027/2819* (2013.01)

(58) Field of Classification Search
CPC .. H01F 27/323; H01F 27/32; H01F 27/2804; H01F 27/324; H01F 2027/2819; H01F 2027/2809; H01F 17/0013; H01F 17/006
USPC ..... 336/200, 212, 232, 220, 221
See application file for complete search history.

(56) References Cited

U.S. PATENT DOCUMENTS 5,015,972 A * 5/1991 Cygan et al. ..... 333/32
5,844,461 A 12/1998 Faulk et al.

(Continued)

FOREIGN PATENT DOCUMENTS

DE 3700488 A1 7/1988
DE 102005041131 A1 5/2007

(Continued)

OTHER PUBLICATIONS

"Related International Application No. PCT/EP2013/000468", "International Search Report and Written Opinion", Feb. 18, 2013, Publisher: PCT, Published in: EP.

(Continued)

*Primary Examiner* — Mangtin Lian
(74) *Attorney, Agent, or Firm* — Kaplan Breyer Schwarz & Ottesen, LLP

(57) ABSTRACT

A planar transmitter, particularly an intrinsically safe transmitter, having a layer structure having a first circuit and at least a second circuit, wherein the first circuit and the second circuit are galvanically separated from one another by means of at least one insulation layer. The transmitter has a first magnetic layer and a second magnetic layer, wherein the first magnetic layer delimits a first side of the layer structure, and the second magnetic layer delimits a second side of the layer structure, wherein the first magnetic layer 4*a* and the second magnetic layer are separated from one another and can be assigned to different potential groups.

5 Claims, 4 Drawing Sheets

(51) Int. Cl.
*H01F 27/24* (2006.01)
*H01F 27/32* (2006.01)

(56) References Cited

U.S. PATENT DOCUMENTS

| | | | | |
|---|---|---|---|---|
| 6,404,317 | B1 | 6/2002 | Mizoguchi et al. | |
| 6,501,364 | B1 | 12/2002 | Hui et al. | |
| 6,888,438 | B2 | 5/2005 | Hui et al. | |
| 2003/0095027 | A1 | 5/2003 | Hui et al. | |
| 2004/0027224 | A1 | 2/2004 | Giandalia et al. | |
| 2006/0109072 | A1* | 5/2006 | Giandalia | H01F 17/0013 336/200 |
| 2006/0214759 | A1 | 9/2006 | Kawarai | |
| 2008/0174396 | A1 | 7/2008 | Choi et al. | |
| 2008/0180206 | A1* | 7/2008 | Fouquet et al. | 336/200 |
| 2010/0079233 | A1* | 4/2010 | Koprivnak et al. | 336/200 |
| 2011/0018676 | A1* | 1/2011 | Young et al. | 336/84 C |
| 2011/0025442 | A1* | 2/2011 | Hsieh | H01F 17/0013 336/200 |
| 2011/0095620 | A1 | 4/2011 | Fouquet et al. | |
| 2011/0140824 | A1 | 6/2011 | Herhold | |

FOREIGN PATENT DOCUMENTS

| | | | |
|---|---|---|---|
| EP | 0715322 | A1 | 6/1996 |
| GB | 2163603 | A | 2/1986 |
| JP | H03171705 | A | 7/1991 |
| JP | 5343245 | A | 11/2013 |

OTHER PUBLICATIONS

Examiner: Klasse, "German Patent Application No: 10 2012 003 365.6", "Office Action", May 8, 2013, Publisher: DPuM, Published in: DE.

Officer: Agnes Wittmann-Regis, "Related International Patent Application No. PCT/EP2013/000468", "International Preliminary Report on Patentability", Sep. 4, 2014, Publisher: PCT/IB, Published in: CH.

* cited by examiner

PLANAR TRANSMITTER WITH A LAYERED STRUCTURE

FIELD OF THE INVENTION

The present invention relates, in general, to the field of interface technology with electronic components, which can be used for measurement, control, and regulation tasks, particularly as buffer amplifiers. These buffer amplifiers make galvanic separation between a primary circuit and a secondary circuit available, and are suitable for intrinsically safe operation, for example.

The present invention relates to a transmitter, particularly a planar transmitter not susceptible to failure, which is suitable for intrinsically safe circuits and will be referred to as a planar, intrinsically safe transmitter hereinafter.

BACKGROUND OF THE INVENTION

Transmitters or transformers, and particularly intrinsically safe transmitters or transformers are used for galvanic separation of circuits according to different standards, where the transmitters can transmit not only energy but also signals and/or data.

In different regulations and standards, for example DIN EN 60079-11, minimum distances for safe separation of circuits and therefore also for the coils or windings of transformers are indicated for different safety classes of operational means. These minimum distances are dependent on the insulation medium, so that the minimum distances are divided into solid insulation, clearance distances, and creepage distances. In a typical insulation class, for example protection level 375 V, the minimal separation distance for solid insulation is 1 mm, for example, the creepage distance in air is 10 mm, and the creepage distance under a protective layer is about 3.3 mm.

Intrinsically safe transmitters are designed and optimized, with regard to their geometry, in such a manner that the required separation distances for a specific protection level are ensured. This can be guaranteed not only by means of wound coils but also by means of printed or etched coils on circuit boards. In this connection, it is advantageous, in the case of printed or etched coils, that no additional winding processes are required, and good reproducibility can be guaranteed. Further advantages can lie in an improved thermal property at the same core volume. Furthermore, the production costs can be lower.

DE 10 2005 041 131 A1 discloses an intrinsically safe transmitter with wound coils, where the windings of the coils are applied to different ring cores on the basis of required insulation distances, which cores are magnetically coupled with one another by way of an additional winding sunk into a circuit board. The transmitter configured in this manner is based on traditional winding technology combined with circuit board technology, where the circuit board is used not only for insulation but also for mechanical fixation.

In US 2011/0140824 A1, a transmitter is proposed, in which the circuits or windings to be insulated are affixed asymmetrically on different circuit boards, which are subsequently connected, one on top of the other, with a magnetic core, to form a transmitter or transformer. In this connection, the core can be formed from two halves, which are glued or stapled together, for example, in order to guarantee mechanical stability.

In US 2011/0095620 A1, a planar transmitter for miniaturized applications is described, having two windings that lie on opposite sides of an insulating substrate. The fundamental physical principle of the transmission of energy or data is based on induction. However, this is not an intrinsically safe transmitter, and no magnetic core is used, either.

In EP 0 715 322 A1, a transmitter or transformer is described, the conductor tracks of which are completely produced using planar technology with a ply structure, in which the conductor tracks are accommodated in a circuit board joined together to form one piece. The conductor track is surrounded by a closed magnetic core.

SUMMARY OF THE INVENTION

It is a task of the present invention to propose miniaturization possibilities of the planar transmitter described above, particularly to allow miniaturization of intrinsically safe planar transmitters.

According to the invention, a planar transformer, preferably an intrinsically safe transmitter, is made available, having a layer structure, for example in the form of one or more circuit boards. The layer structure can have a plurality of circuits, where at least a first circuit and at least a second circuit are galvanically insulated from one another, preferably in intrinsically safe manner. Furthermore, the transmitter has a first magnetic layer and a second magnetic layer, where the first magnetic layer delimits a first side of the layer structure, and the second magnetic layer delimits a second side of the layer structure.

In this connection, magnetic layers characterize layers, for example small plates of a material that has a conductive effect on magnetic fields. These can particularly be ferrite plates.

The transmitter therefore has at least a first circuit and at least a second circuit within a layer structure, where the first circuit and the second circuit are galvanically separated from one another by means of at least one insulation layer. Different potential groups or circuits can be assigned to the first magnetic layer and the second magnetic layer.

In this connection, the first circuit is the primary circuit, for example, and the second circuit is the secondary circuit, for example, of a transformer. Furthermore, the transmitter or transformer has a first magnetic layer and a second magnetic layer, where the first magnetic layer delimits a first side of the layer structure, and the second magnetic layer delimits a second side of the layer structure. It is provided that the first magnetic layer and the second magnetic layer are separated from one another and can be assigned to different potential groups or circuits.

The two magnetic layers thereby form magnetic cores or core parts that are galvanically separated from the nearest circuits, for example by means of varnish, so that windings of the coils of one magnetic layer cannot be short-circuited by a magnetic layer.

The technical solution therefore lies in making available a transmitter having a non-closed or greatly opened magnetic core, in which a first magnetic layer and a second magnetic layer are separated from one another and can have different potentials or can be assigned to different circuits. The transmitter can have a layer structure, which is based on a printed circuit board having multiple layers. Also, etching methods can be used to produce the layer structure.

Therefore a transmitter or transformer is made available, the magnetic core of which is separated. Synonymously, it is possible to speak of multiple coupled coils, the magnetic fields of which are guided with shielding ferrites. Alternatively or in addition, the concept of a transformer with an air gap can also be selected.

The transmitter or transformer according to the invention is therefore also suitable for fulfilling all the safety distances required according to the standard DIN EN 60079-11, and, at the same time, offers functionality with regard to transmission of energy and/or data or signals.

According to particularly preferred exemplary embodiments, it can therefore be provided that a minimum insulation distance between the first circuit and at least the second circuit makes intrinsically safe galvanic separation available.

According to the invention, the total thickness of a transmitter is reduced or minimized. This is particularly advantageous if the transmitters are supposed to be integrated into narrow housings, which have a total thickness of approx. 6 mm, for example, and if maximally about 4.5 mm space is available within the housing. Therefore it is a particular advantage of the invention to be able to make available a transmitter and, in particular, also an intrinsically safe transmitter, which does not exceed a total thickness of 4.5 mm, for example. It is an advantage of the invention that the construction height of the transmitter and preferably intrinsically safe transmitter is reduced, while the horizontal dimensions remain the same.

According to an exemplary embodiment of the transmitter according to the invention, the first circuit is disposed on a first layer and the second circuit is disposed on a second layer, where an insulation layer is disposed between the first layer and the second layer, in each instance. In this connection, the insulation layer can be viewed as the main insulation layer, while further insulation layers can also be used as secondary insulation layers, within the first and/or second circuit, in order to make available electrically conductive coils having multiple windings, for example, in that the circuits have multiple layers, for example, which can be connected by way of an electrical contact, for example within the secondary insulation.

According to an exemplary embodiment of the transmitter according to the invention, it can be provided that the first circuit borders on the first magnetic layer, and the second circuit borders on the second magnetic layer.

In this manner, the other conventional insulations on the magnetic core, particularly between the individual circuits and the core, can be eliminated, because the core is divided into multiple parts, and the individual parts of the core can be assigned to the nearest circuits, in each instance, and to their potentials. This is possible, among other things because the parts of the magnetic core can assume different potentials, and are not electrically and mechanically connected with one another.

It is therefore provided that the first circuit borders on the first magnetic layer, and the second circuit borders on the second magnetic layer. In this connection, "border on" should be understood to mean that the layers are in the immediate vicinity of one another, but do not have to touch, because a varnish layer is present between the layers, for example.

According to an embodiment of the transmitter according to the invention, it can be provided that the first circuit and the second circuit have a minimum insulation distance T0 from one another and that the distance between the first circuit and the second circuit does not go below the minimum insulation distance T0 at any geometrical location, where it is practical if the minimum insulation distance is designed in such a manner that an intrinsically safe galvanic separation between the first circuit and a second circuit is made available.

According to an embodiment of the transmitter according to the invention, a total insulation thickness between the first magnetic layer and the second magnetic layer of $(N-1)\times T0$ can be provided, where T0 is the minimum insulation distance and is preferably designed in such a manner that an intrinsically safe galvanic separation between the first circuit and a second circuit is made available, and N is the number of circuits galvanically separated from one another. Therefore a reduction in the number of insulation layers in the vertical direction (direction along the layer structure) takes place, particularly also in the case of N windings separated in intrinsically safe manner, in such a manner that the required total insulation layer in the vertical dimension between the magnetic core parts of the transmitter amounts to only (N−1) times the minimum thickness of T0, in other words $(N-1)\times T0$ instead of conventionally $N\times T0$.

According to an embodiment of the transmitter according to the invention, the total thickness of the transmitter is not more than about 4 mm at a required minimum insulation thickness T0 of an insulation layer of about 1 mm. Thicknesses of conductor tracks, insulation materials, ferrites, varnishes, etc. are taken into consideration in the total thickness of the transmitter.

Furthermore, the space requirement of the transmitter is reduced or minimized. This increases the available space for other electronic components, for example, and can be made possible by means of greater frequencies and/or different materials.

Also, the geometry of the magnetic cores or core parts can be optimized or minimized in such a manner that the space requirement becomes minimal and the geometric shape of the cores or core parts becomes as simple as possible. This is in harmony with required cost optimization of electronic devices, which particularly contain intrinsically safe transmitters. Furthermore, because of the non-closed magnetic core, the conventionally required recesses in the circuit board are eliminated, and this can save space and costs. A further advantage of the invention is that the core parts can be applied to the ply structure with standard gluing methods and usual tolerances, in cost-advantageous manner, and the transmitter can thereby be produced in cost-advantageous manner.

Because of the absence of a closed or almost closed core, additional demands on the circuit design can arise, because the inductances and couplings of the coils are typically reduced due to this measure. This can be compensated by means of suitable counter-measures. Thus, for example, capacitative effects can be utilized for efficient energy transfer and for compensation of the leakage inductances that occur, and this can frequently lead to one or more resonances in the system.

BRIEF DESCRIPTION OF THE DRAWINGS

Some exemplary embodiments of the invention are shown, purely schematically, in the drawings, and will be described in greater detail below. The drawings show.

DETAILED DESCRIPTION

Figure 1:
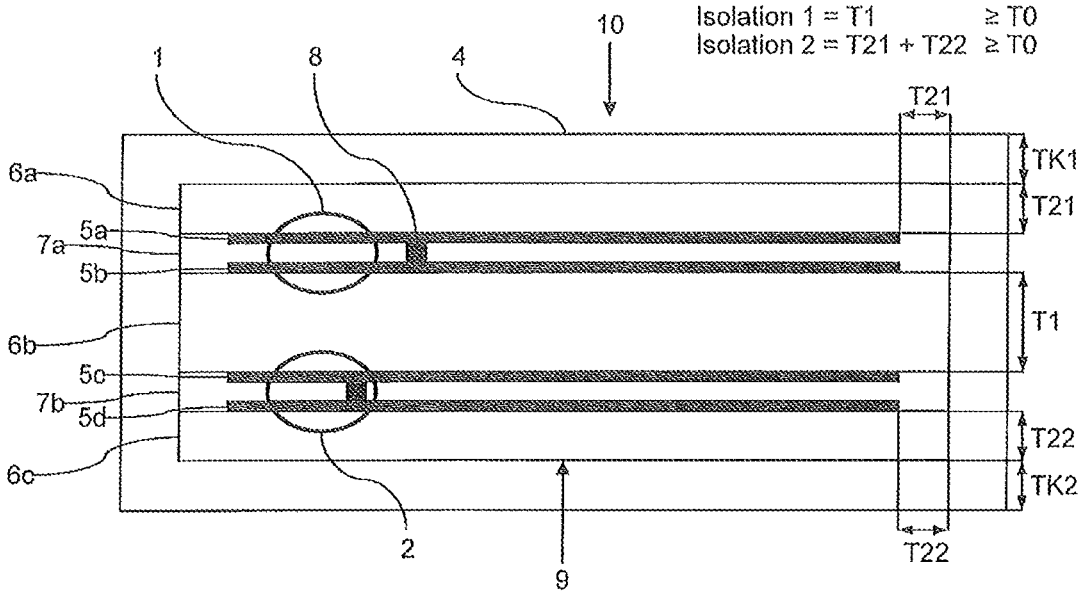
Fig. 1 (Prior Art)
FIG. 1 a schematic representation of a conventional transmitter having two circuits.

FIG. 1 shows a schematic representation of a conventional transmitter 10 having a first circuit 1 and a second circuit 2. The transmitter 10 is configured, for example, as an intrinsically safe circuit board transmitter, as known from EP 0 715 322 A1. The transmitter 10 has a ply structure with a primary side and a secondary side, which sides are formed, in each instance, by the two circuits 1, 2.

FIG. 1 shows a cross-section through a circuit board 9, which is enclosed by a core 4, where the core 4 penetrates the circuit board 9 at several locations. The penetration can be made available by means of milled areas in the circuit board 9, for example. The circuit board 9 has multiple plies, which is composed of layers of conductor tracks 5*a* to 5*d* and insulation layers 6*a* to 6*c* as well as 7*a* to 7*b*. In this special ply structure, the insulation layers can be divided into those (6*a* to 6*c*) that separate the individual circuits 1, 2 from one another and those (7*a* to 7*b*) that provide insulation within the individual circuits. The insulation layers 7*a* to 7*b* allow varied conductor structures, such as spiral-shaped windings on the ply 5*a*, for example, which can be provided with a return conductor on the ply 5*b*. The plies within a circuit can be connected with an electrical contact 8, such as a through-hole contact, for example.

In the ply structure of the intrinsically safe transformer from FIG. 1, the two circuits 1, 2 or potential groups 1, 2 are galvanically separated from one another by way of a first solid insulation or solid material insulation having the thickness T1 (insulation 1). In this connection, for an intrinsically safe transmitter, the insulation thickness T1 is greater than or equal to the protection level required for the protection class, and this is a necessary prerequisite for an intrinsically safe transmitter. In this case, the required protection level thereby corresponds to the minimum insulation distance T0, also referred to as a required insulation thickness or minimum insulation thickness. Because the core 4 is considered to be a conductive body, not only the required first insulation between the primary side and the secondary side (insulation 1) but also a second insulation between the individual windings of the circuits and the core 4 must be ensured (insulation 2). In this connection, the second insulation can be divided up into two parts T21 and T22, where the sum of the thicknesses T21 and T22 of the second insulation is also greater than or equal to the minimum insulation thickness T0 required for the protection class. For example, the two parts of the second insulation have the same thickness.

An additional ancillary requirement for the design of a transmitter is contained, for example, in DIN EN 60079-11, in such a manner that none of the two parts T21 and T22 is allowed to drop below a minimum proportion of the total second insulation, for example one-third of the second insulation. In general, for reasons of symmetry, the two parts T21 and T22 are selected to be identical and equal to half the first insulation.

The traditional circuit board transmitter 10 is equipped with a magnetic core 4, in order to achieve the most optimal magnetic conductivity possible, combined with a maximal shielding effect. In this connection, the magnetic core 4 encloses the circuit board 9 or parts of the circuit board, with or without an air gap, and is disposed not only above but also below the circuit board 9, as well as to the sides of the circuit board 9, in each instance. Because the production-related thicknesses TK1 and TK2 of the magnetic core above and below the circuit board 9 are typically greater than the required insulation thickness T0, at TK1, TK2>T0 (if T0 amounts to 1 mm, for example), a total thickness of the circuit board transformer 10 of at least four times the minimum insulation thickness T0 results. In this connection, the layer thicknesses of the conductor tracks (5*a* to 5*d*) as well as the thicknesses of the additional insulation layers (7*a* to 7*b*) have not yet been included.

If the required thickness of the insulation layer T0 amounts to 1 mm, for example, the total thickness of the traditional circuit board transmitter 10 is greater than 4 mm. In many applications, the thickness amounts to between 6 mm and 12 mm at a total surface area of approx. 6 $cm^2$ to 8 $cm^2$.

Figure 2:
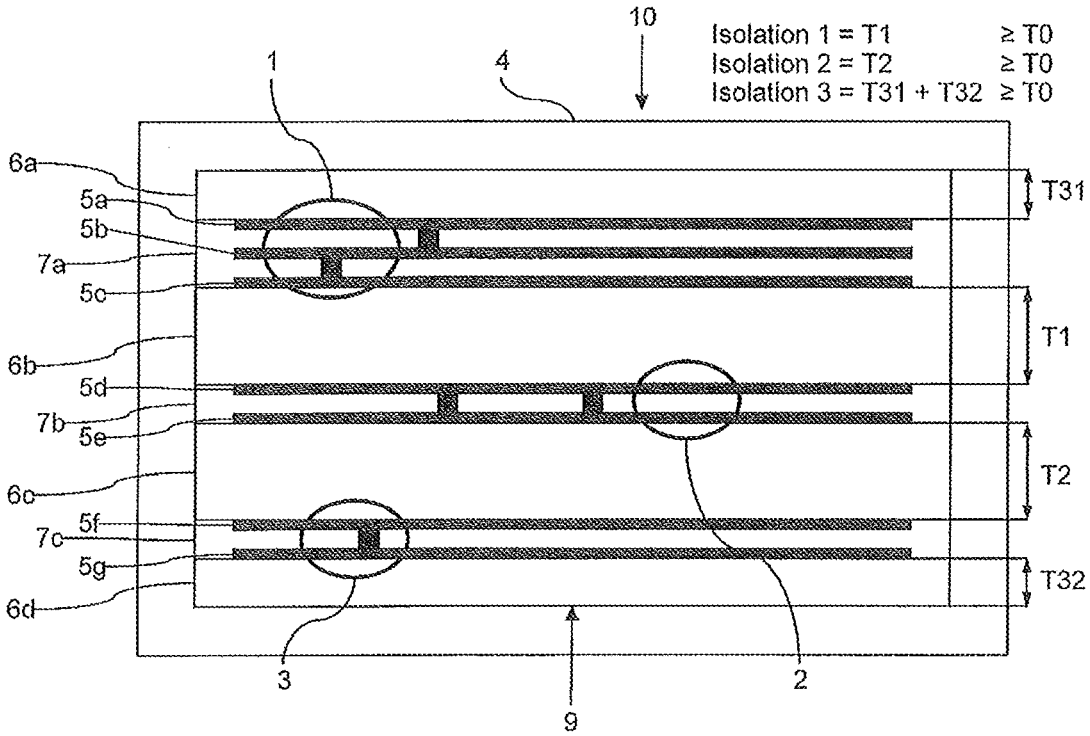
Fig. 2 (Prior Art)
FIG. 2 a schematic representation of a conventional transmitter having three circuits.

FIG. 2 shows a schematic representation of a conventional transmitter 10 having three circuits 1, 2, 3. FIG. 2 illustrates a ply structure of a circuit board 9 in the case of three circuits 1, 2, 3 safely separated galvanically, as a further embodiment variant proceeding from FIG. 1. The windings of the first circuit 1 or of the first potential group 1 are structured as three conductor track planes 5*a* to 5*c* in this example, while the windings of the circuit 2 and of the circuit 3 are structured with two conductor track planes 5*d* and 5*e* or 5*f* and 5*g*, respectively.

As a conclusion from the above concept of intrinsically safe operation, three insulation layers with a first insulation (insulation 1), a second insulation (insulation 2), and a third insulation (insulation 3) must be used for safe galvanic separation of all three circuits 1, 2, 3, which insulations must be selected, in each instance, to be greater than or equal to the minimum insulation thickness T0 that corresponds to the protection level required for the protection class. In this way, the total thickness of the transformer 10 is consequently increased. In general, it holds true that the total insulation thickness at N circuits safely separated from one another galvanically amounts to at least N×T0. The total thickness of the transmitter 10 takes further layer thicknesses into consideration, such as the conductor track thickness 5*a* to 5*g* and the further insulation layers 7*a* to 7*c*.

As explained above, it is a necessary prerequisite for intrinsically safe transformers and also for intrinsically safe separation of two circuits that a minimum insulation distance between the circuits to be separated galvanically must be made available, which distance corresponds to the protection level required for the corresponding protection class.

In the exemplary embodiments described below, it can therefore be provided, in practical manner, that a minimum insulation distance between the first circuit and at least a second circuit makes such intrinsically safe galvanic separation available. In the case of an intrinsically safe transmitter, the minimum insulation distance, also referred to as a required insulation thickness or minimum insulation thickness, corresponds to the protection level required for the protection class.

A minimum insulation distance between the circuits can also be practical and advantageous for a design of the transmitter not with intrinsically safe operation, but designed according to other regulations or standards.

Figure 3:
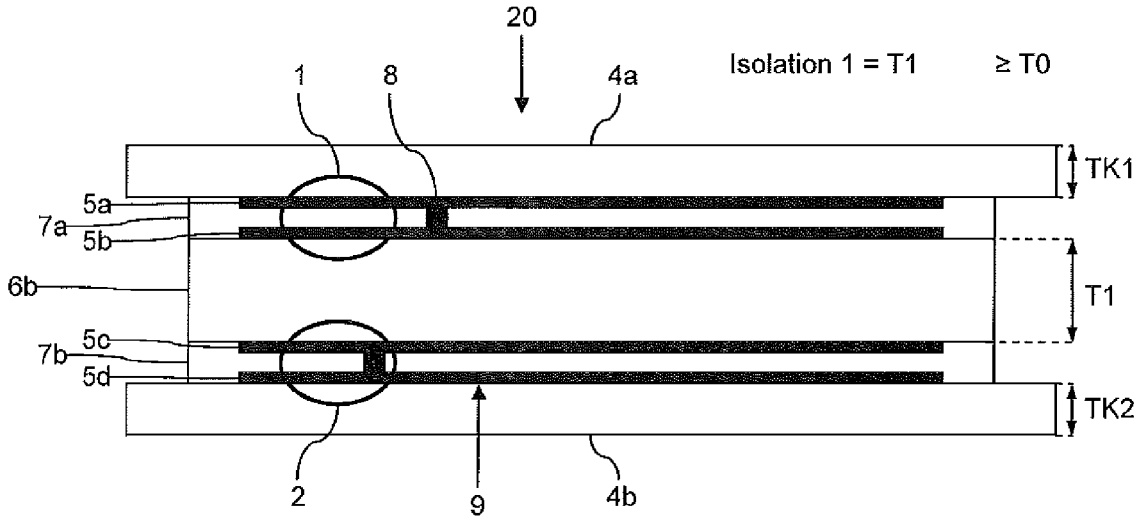
FIG. 3 a schematic representation of a transmitter having two circuits, according to a first exemplary embodiment of the invention.

FIG. 3 shows a schematic representation of a transmitter 20 according to an exemplary embodiment of the invention, having a first circuit 1 and a second circuit 2, which are galvanically separated from one another.

The construction height of the transmitter 20 can be reduced, according to the invention, because the originally closed or almost closed magnetic core 4, which is shown in FIG. 1 and FIG. 2, has been eliminated. Instead, the magnetic core 4 is formed from different parts 4*a* and 4*b*, which are formed from ferrite plates, for example, and can essentially cause a shield effect of the magnetic field.

By means of separating the core 4 into two core parts 4*a*, 4*b*, it is possible to eliminate the second insulation (insulation 2) of FIG. 1 or the third insulation (insulation 3) of FIG. 2 between the circuits 1, 2, 3 and the core 4. It is provided, as shown in FIG. 3, that no connection is present between the core parts 4*a*, 4*b*, which are viewed as being electrically conductive. In this connection, the core parts 4*a*, 4*b* can be assigned to the nearest potential groups 1, 2, in each instance.

The present invention therefore utilizes a method of procedure, which will be described in greater detail below, to reduce the total thickness of the known ply structure shown in FIG. 1 and FIG. 2. As described, the total insulation thickness amounts to at least N×T0 according to the known dimensioning according to FIG. 1 and FIG. 2, where N refers to the number of safely separated circuits 1, 2, 3 and T0 is the minimum insulation thickness in the insulating medium that takes the protection level into account.

By means of the separation of the core 4, as described, it is possible to eliminate the insulation layers 6*a* and 6*c* from FIGS. 1 and 6*a* and 6*d* from FIG. 2, and the total thickness of the transformer is reduced accordingly, by at least 1×T0. In general, it is therefore possible to reduce the total insulation thickness from at least N×T0 to (N−1)×T0.

According to the invention, the total insulation thickness is reduced to (N−1)×T0 by means of separating the magnetic core 4 into two parts 4*a*, 4*b*. In the special case of two (N=2) circuits 1, 2 to be insulated, the minimal insulation thickness is reduced from 2×T0 to 1×T0, by a reduction factor of two. In general, the reduction factor is accordingly N/(N−1).

It is advantageous if the minimal distance between all the core parts 4*a*, 4*b* also corresponds at least to the required minimum insulation, in order to make an intrinsically safe transmitter 20 available. In this connection, it must be taken into consideration that the required separation distance between the core parts can vary, depending on the insulation medium.

Figure 4:
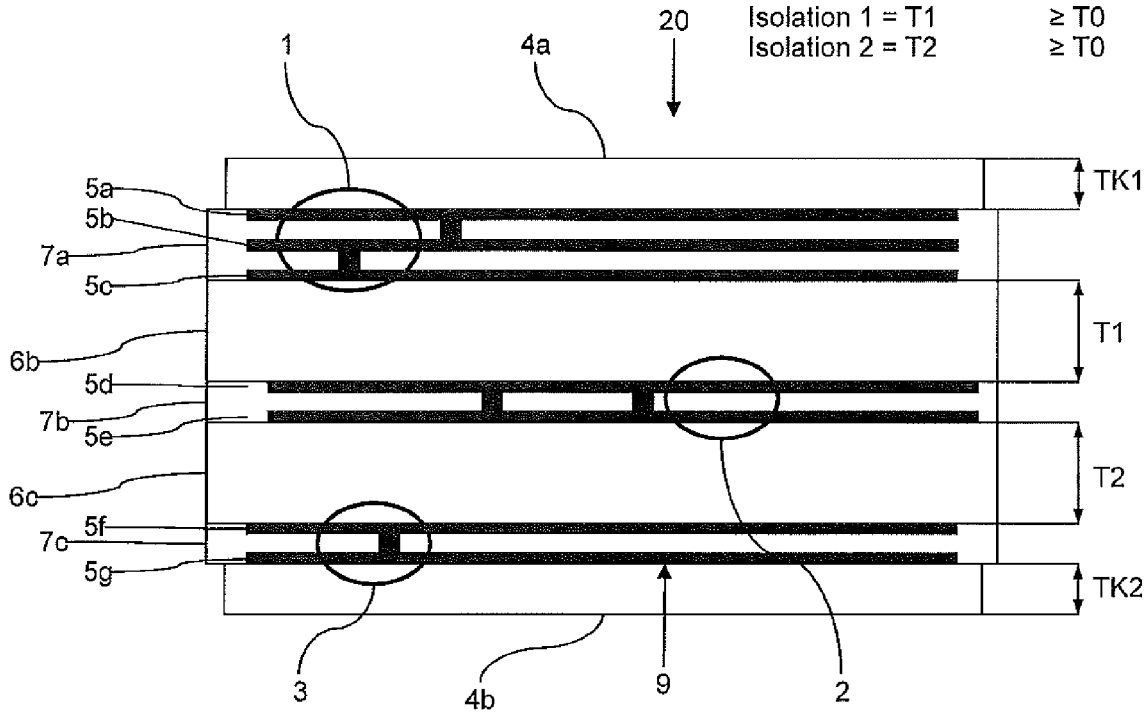
FIG. 4 a schematic representation of a transmitter having two circuits, according to a second exemplary embodiment of the invention.

FIG. 4 shows a further exemplary embodiment of a transmitter 20 according to the invention. In this connection, the transmitter 20 has a first circuit 1, a second circuit 2, and a third circuit 3. The overlaps of the core parts 4*a*, 4*b* relative to the circuit board 9 of the transmitter 20 in FIG. 4 are different in comparison with FIG. 3. Furthermore, in FIG. 4 the second circuit 2 is shifted to the right, in other words offset relative to the first circuit 1. Therefore the circuits 1, 2, 3 are oriented differently in this exemplary embodiment.

Figure 5:
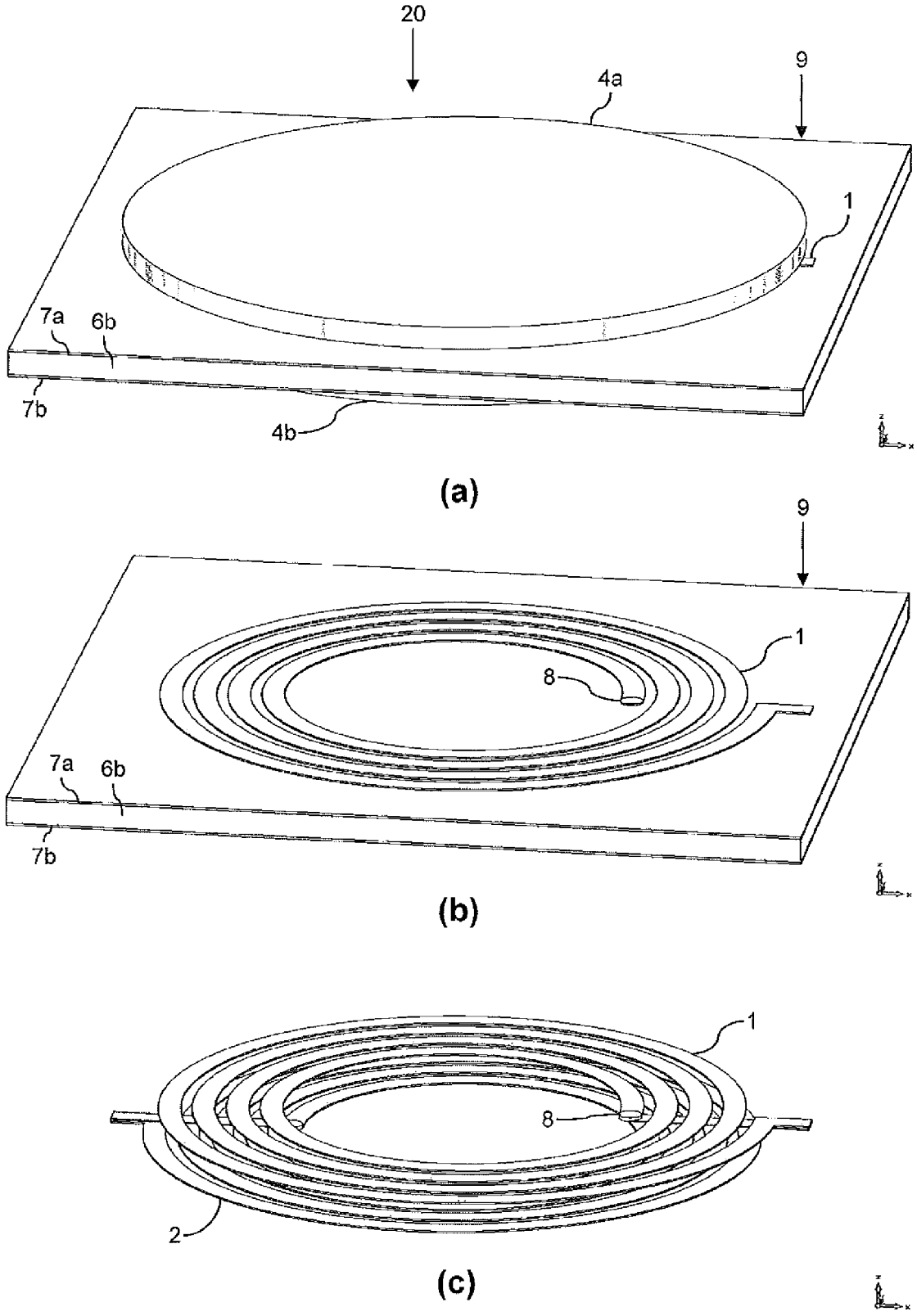
FIG. 5(*a*)-5(*c*) and FIG. 6 a schematic representation, in each instance, in different views, of a transmitter having two spiral-shaped coils, according to a third exemplary embodiment of the invention.
Figure 6:
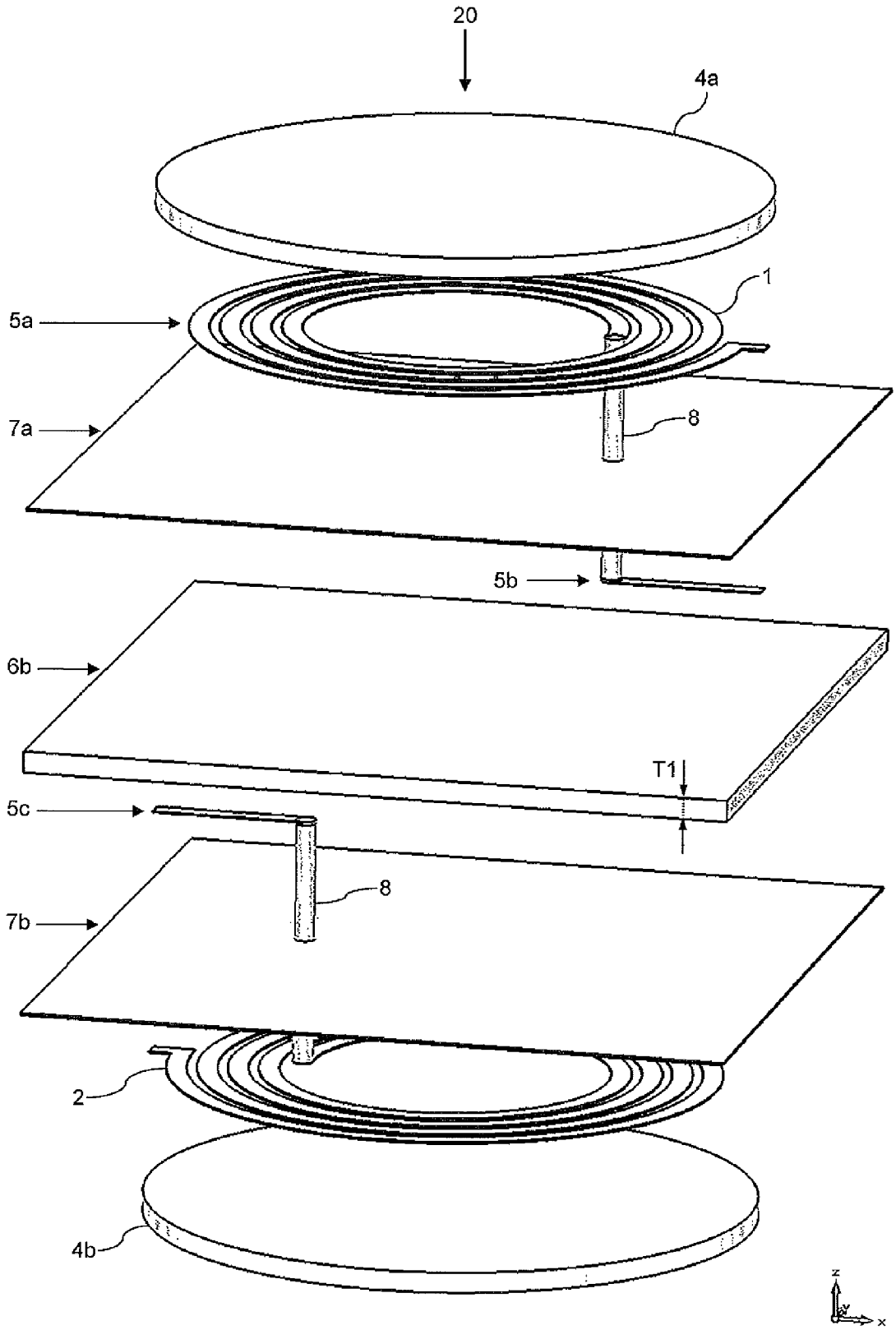

FIGS. 5 and 6 show another exemplary embodiment of an intrinsically safe transmitter 20 according to the invention, in different perspectives.

In FIG. 5, three different views of a transmitter 20 are shown. In FIG. 5 (*a*), the complete transmitter 20 can be seen; in FIG. 5 (*b*), the transmitter 20 is shown without the core parts 4*a*, 4*b*; and in FIG. 5 (*c*), the circuit board 9 has additionally been removed.

In FIG. 6, all the layers of the transmitter 20 from FIG. 5 are shown in an exploded view. The circular basic shape of the coils from FIG. 5 and FIG. 6 can also be modified in such a manner that a rectangular basic shape with spiral-shaped windings occurs. Accordingly, it can be practical, in this case, to also structure the basic shape of the core parts 4*a*, 4*b* in rectangular manner.

In FIGS. 5 and 6, the two circuits of the potential groups 1 and 2 are disposed on different plies of the circuit board 9. The two potential groups 1, 2 are insulated by way of the insulation layer 6*b* having the thickness T1, which is greater than or equal to the minimum insulation thickness T0 of the respective protection group. In the case of spiral-shaped coils, the inner winding can be provided with a contact 8 and returned on an additional ply 5*b*, 5*c*.

To increase the electromagnetic coupling between the two coils 1, 2 and to reduce or minimize stray fields, magnetic materials can be affixed above and below the circuit boards 9.

In the exemplary embodiments of FIG. 5 and FIG. 6, this is implemented by means of two cylindrical ferrite plates 4*a* and 4*b*. The total thickness of the transmitter 20 formed in this way amounts to 3.6 mm, for example, while the expanse in the x direction and in the y direction amounts to approx. 20 mm, in each instance.

In the transformers or transmitter 20 of FIG. 3 to FIG. 6 as described, it can be provided that the individual windings, provided with the corresponding safety distances, are applied one on top of the other, in a special layer structure. Therefore there are insulation layers (first layers) for the required separation distances, and further, significantly thinner insulation layers (additional layers) that serve for return of a conductor track within a winding. This is necessary, among other things, if a spiral-shaped winding must be passed from the inside to the outside on a different ply. The transformer or transmitter formed in this way can fulfill all the safety distances required according to the standard DIN EN 60079-11, and simultaneously offers the functionality with regard to transmission of energy and/or data or signals.

REFERENCE SYMBOL LIST

1 circuit or potential group
2 circuit or potential group
3 circuit or potential group
4 magnetic core, e.g. ferrite core
4*a* first part of a magnetic core
4*b* second part of a magnetic core
5*a* to 5*g* conductor track layers
6*a* to 6*d* insulation layers between the circuits
7*a* to 7*c* insulation layers within a circuit
8 electrical contacting
9 circuit board
10 conventional transmitter or transformer
20 transmitter or transformer according to the invention
T0 minimum insulation/protection level/insulation thickness
TK1 first thickness of a magnetic core
TK2 second thickness of a magnetic core
T1 first insulation thickness
T2 second insulation thickness
T21 distance/insulation thickness
T22 distance/insulation thickness
T31 distance/insulation thickness
T32 distance/insulation thickness

What is claimed is:

1. A planar transmitter having:

a layer structure having a plurality of circuits, wherein a first circuit and at least a second circuit are galvanically separated from one another by means of at least one first insulation layer, a magnetic core of a non-closed structure, in which a first magnetic layer and a second magnetic layer are separated from one another and are assigned to different potential groups, wherein the first magnetic layer delimits a first side of the layer structure, and the second magnetic layer delimits a second side of the layer structure, wherein the first circuit borders on the first magnetic layer, and the second circuit borders on the second magnetic layer, wherein at least two conductive layers form one or more windings of a coil, in that the conductive layers are connected with an electrical connection, wherein the first circuit and the second circuit have a minimum insulation distance T0 from one another, wherein the minimum insulation distance makes at least one of galvanic separation between the first circuit and the second circuit and, intrinsically safe galvanic separation, available, wherein the distance between the first circuit and the second circuit does not go below the minimum insulation distance T0 at any geometrical location, wherein a total insulation thickness between the first magnetic layer and the second magnetic layer amounts to $(N-1)\times T0$, and wherein T0 is the minimum insulation distance and N is the number of circuits safely separated from one another galvanically, and wherein, at a required minimum insulation distance T0 of the first insulation layer of about 1 mm, the total thickness of the transmitter does not amount to more than about 4 mm.

2. The transmitter according to claim 1, wherein the first circuit is disposed on a second insulation layer, and the at least second circuit is disposed on a third insulation layer, and wherein the first insulation layer is disposed between the second insulation layer and the at least third insulation layer, in each instance.

3. The transmitter according to claim 1, wherein at least one of the first circuit and the second circuit is formed from the two conductive layers and wherein a second insulating layer is disposed between the two conductive layers.

4. The transmitter according to claim 1, wherein the minimum insulation distance T0 amounts to at least about 0.25 mm.

5. The transmitter according to claim 1, wherein a total height of the transmitter does not exceed four times a total insulation distance of the insulation between a primary side, configured as the first circuit, and a secondary side, configured as the second circuit.

* * * * *